US006789945B2

(12) United States Patent
Möbs et al.

(10) Patent No.: US 6,789,945 B2
(45) Date of Patent: Sep. 14, 2004

(54) SEALED THREE-SIDED POUCH WITH TWO CHAMBERS

(75) Inventors: Heinrich-Stephan Möbs, Bad Nauheim (DE); Gerd Knaup, Nidda (DE)

(73) Assignee: Hassia Verpackungsmaschinen GmbH, Ranstadt (DE)

( * ) Notice: Subject to any disclaimer, the term of this patent is extended or adjusted under 35 U.S.C. 154(b) by 74 days.

(21) Appl. No.: 10/211,482

(22) Filed: Aug. 2, 2002

(65) Prior Publication Data

US 2004/0022458 A1 Feb. 5, 2004

(51) Int. Cl.[7] ..... B65D 30/00

(52) U.S. Cl. ..... 383/37; 383/38; 383/200; 383/207; 383/208; 383/209

(58) Field of Search ..... 203/586; 222/94, 222/107; 383/37, 38, 209, 208, 207, 201, 200

(56) References Cited

U.S. PATENT DOCUMENTS 386,398 A 7/1888 Giles
2,245,738 A * 6/1941 Taylor ..... 206/568
2,851,212 A * 9/1958 Parmer ..... 383/200
3,008,835 A * 11/1961 Madding ..... 426/120
3,608,709 A * 9/1971 Pike ..... 206/219
4,619,650 A * 10/1986 Wisdom ..... 604/408
4,696,404 A * 9/1987 Corella ..... 383/200
5,024,536 A * 6/1991 Hill ..... 383/38
5,132,036 A * 7/1992 Falou et al. ..... 510/277
5,169,696 A * 12/1992 Lang et al. ..... 428/35.2
6,006,501 A 12/1999 Davis et al.
6,352,364 B1 3/2002 Möbs
6,624,130 B2 * 9/2003 Giblin et al. ..... 383/208

* cited by examiner

*Primary Examiner*—Robin A. Hylton
(74) *Attorney, Agent, or Firm*—Collard & Roe, P.C.

(57) ABSTRACT

A three-sided pouch formed from a sealable foil comprises two parallel longitudinally extending tubular chambers. A longitudinal bendable sealing seam separates the chambers. Transversely extending sealing seams close the opposite ends of the tubular chambers. In order to enable such pouches to be easily opened, one of the transversely extending seams has a widened portion straddling the longitudinally extending sealing seam and extends to both tubular chambers. A tearing aid for facilitating the tearing open of the two tubular chambers is arranged in the widened portion.

4 Claims, 2 Drawing Sheets

SEALED THREE-SIDED POUCH WITH TWO CHAMBERS

BACKGROUND OF THE INVENTION

1. Field of the Invention

The present invention relates to tubular bag-type packings and, in particular, it relates to so-called three-sided pouches formed from a sealable foil and comprising two longitudinally extending tubular chambers.

2. Description of the Prior Art

Such three-sided pouches of the afore-mentioned type are molded to form two longitudinally extending tubular chambers extending parallel to each other and having opposite ends. A longitudinally extending sealing seam separates and closes the tubular chambers in the longitudinal extension. Transversely extending sealing seams close the opposite ends of the tubular chambers. Three-sided pouches of the afore-described type have been disclosed, for example, in U.S. Pat. No. 6,006,501. This patent describes also a mashine and method of making such three-sided pouches. Such three-sided pouches with two chambers extending parallel to each other are destined for to enclose two different mediums within the two chambers, for example milk and sugar, different salad dressings, tomato ketchup and mustard or also different chemical components, etc. In order to enable such dispenser pouches in general to be easily and faultlessly opened it is well known to provide such dispenser pouches with tearing aids as described for instance in U.S. Des. Pat. No. 386,398 and also in U.S. Pat. No. 6,352,364. These tearing aids are arranged just beneath one of the transversely extending sealing seams, and within a widened portion at one end or both ends of the transversely extending sealing seam. As to the three-sided pouches disclosed in the aford-mentioned U.S. Pat. No. 6,006,501 no such tearing aids are provided, but it would be no problem to provide such tearing aids also at the outer margins of every chamber of such double chambered three-sided pouches. This would have the disadvantage, that both chambers must be opened separately and that it would not be possible to squeeze out centrally both components out of the two chambers.

SUMMARY OF THE INVENTION

It is, therefore, a primary object of the present invention to provide a new and improved double-chambered three-sided pouch, wherein both chambers can be opened together at the same time and that both components flow together and will be mixed to a certain degree during squeezing out.

Another object of the present invention is to provide a new and improved double-chambered three-sided pouch, wherein the chambers can be separated without problems along the longitudinally extending sealing seam between the two chambers.

The foregoing and other objects are attained in accordance with one aspect of the present invention by providing of a double three-sided pouch with two chambers, wherein one of the transversely extenting sealing seams has a widened portion straddling the longitudinally extending sealing seam and extending to both tubular chambers, and within the widened portion has a tearing aid effective for both chambers.

This configuration makes it possible, after bending the longitudinally extending sealing seam and folding together the two chambers of the pouch, to tear open the two chambers simultaneously, since there is only one tearing aid for and between both chambers.

Besides this, the sealing tool for producing the transversely extending sealing seam inclusive the widened portion needs only one element for the attachment of the tearing aid. Furthermore this facilitates the bending of the longitudinally extending sealing seam and also the folding of the two chambers together and further, if wanted, to separate the two three-sided sealed chambers of the pouch before tearing off.

BRIEF DESCRIPTION OF THE DRAWINGS

Various objects, features and attendant advantages of the present invention will be more fully appreciated as the same becomes better understood from the following detailed description thereof when considered in connection with the accompanying drawings, wherein.

DETAILED DESCRIPTION OF THE PREFFERED EMBODIMENTS

Figure 1:
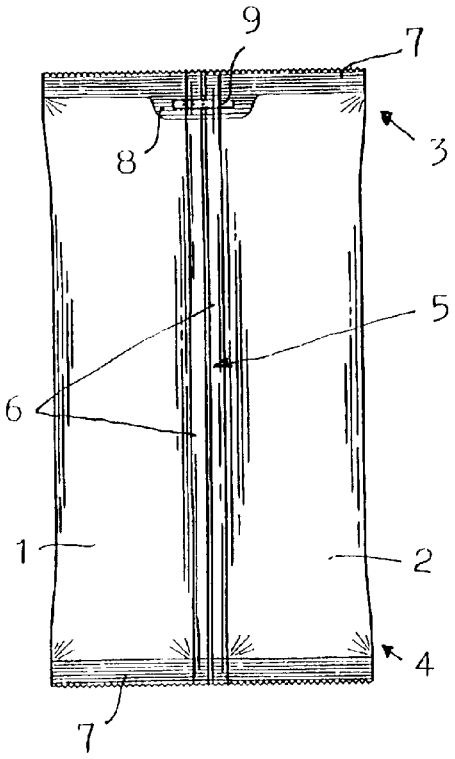
FIG. 1 shows a front elevational view of an embodiment of the double three-sided sealed pouch.
Figure 2:
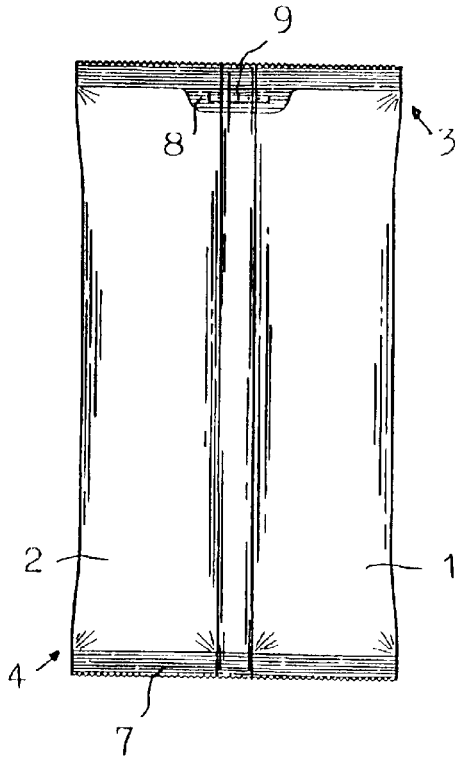
FIG. 2 shows a rear elevational view of the pouch according of FIG. 1.
Figure 3:
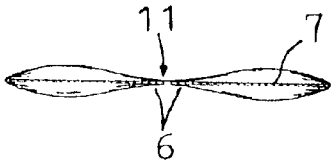
FIG. 3 shows a top plan view of the embodiment according FIG. 1.

The three-sided pouches are made of a foil 10 of at least one layer molded into two chambers 1, 2 extending parallel to each other and having opposite ends 3, 4. A longitudinally extending sealing seam 5 separates the chambers 1, 2. Sealing seam 5 is formed by the two longitudinally extending end margins 6 of the foil 10 so that the sealing seam 5 is bendable along and between these margins 6. Transversely extending sealing seams 7 close the opposite ends 3, 4 of the tubular chambers 1, 2.

Figure 6:
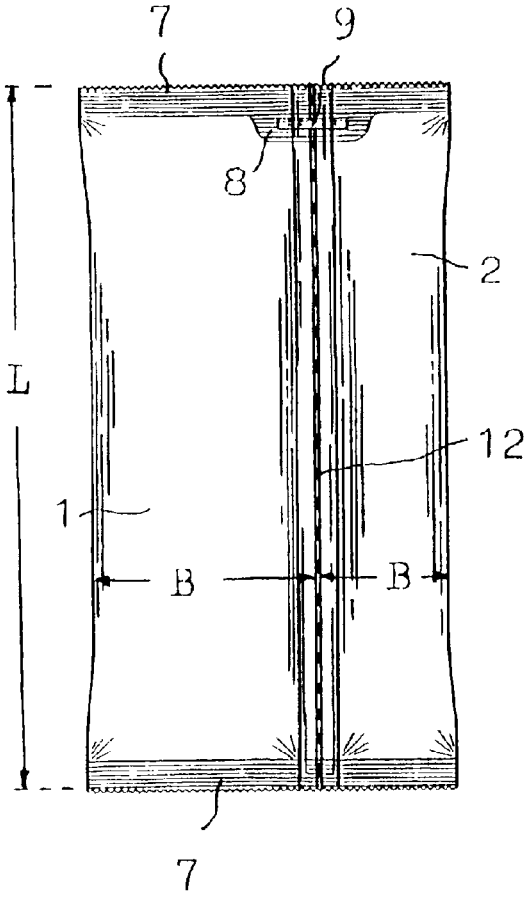
FIG. 6 shows a front elevational view of another embodiment, the two chambers having widths.

The other embodiment shown in FIG. 6 has basically the same configuration, with the difference that the two tubular chambers 1 and 2 are of different width B.

According to the present invention, one of the transversely extending seams 7 has a widened portion 8 straddling the longitudinally extending sealing seam 5 and extending to both tubular chambers 1,2, as shown in FIGS. 1,2,6 and 7. As can be seen in the rear elevational view of FIG. 2 at the rear side of the three-sided sealed pouch there are no end margins 6 of the foil 10 whereof the pouch is made.

Within the relatively small area of the widened portion 8 is arranged a device for facilitating the tearing open of the two tubular chambers 1,2. This device for instance in form a punctual or a line perforation 9 crosses the longitudinally extending sealing seam 5 and extends to both parts of the widened portion 8 of the chambers 1,2.

Figure 5:
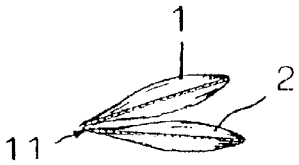
FIG. 5 shows a top plan view of the pouch in folded position of the two chambers.
Figure 4:
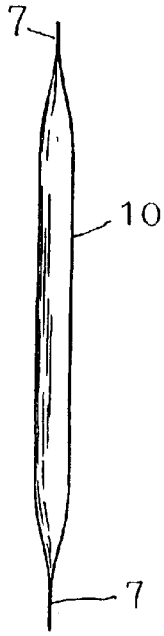
FIG. 4 shows a side view of the embodiment according FIG. 1 and FIG. 2.

In FIG. 5 is shown the folded position of the pouch after bending this pouch along the the central line 11 defined by the end margins 6 of the foil 10. In this position the mentioned tearing aid, i.e. the perforation 9, is also folded and both chambers 1,2 are accessible for tearing off simultaneously.

Figure 7:
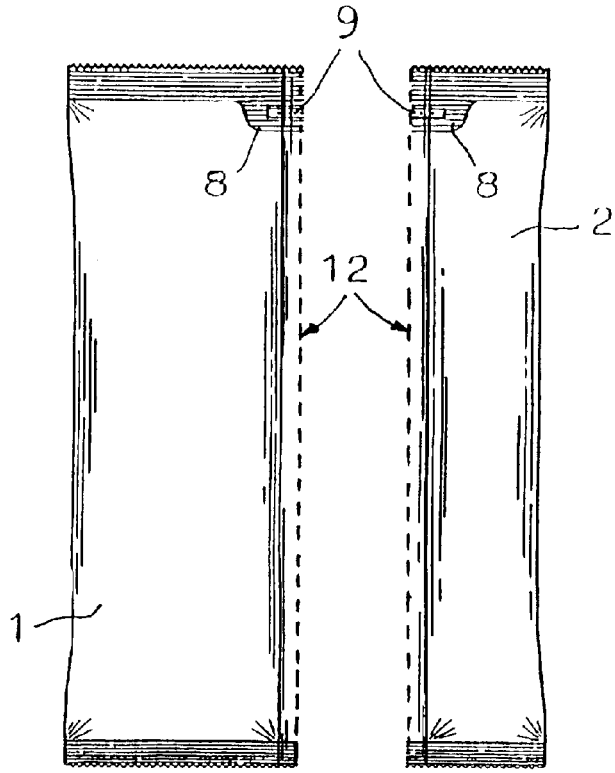
FIG. 7 shows front elevational views of the embodiment according FIG. 6 but with separated chambers.

In a further embodiment of the invention shown in FIGS. 6 and 7, a longitudinally extending tearing aid 12 for facilitating the separation of the two tubular chambers 1,2, extends substantially centrally along the length of the longitudinally extending sealing seam 5. Such a tearing aid 12 could be also be provided in the embodiment of FIG. 1.

FIG. 7 shows the two tubular chambers 1,2 separated after tearing of the perforation 12 (represented by dotted lines in FIGS. 6,7.) along the whole length L of the pouch. As also visible in FIG. 7, the separated parts of perforations 9 are also available for separate tearing open the chambers 1,2.

What is claimed is:

1. A three-sided pouch comprising two longitudinally extending tubular chambers extending parallel to each other and having opposite ends; a longitudinally extending sealing seam separating the chambers, the sealing seam being bendable; transversely extending sealing seams closing the opposite ends of the tubular chambers, one of the transversely extending seams having a widened portion straddling the longitudinally extending sealing seam and extending to both tubular chambers; and a device within the widened portion for facilitating the simultaneous tearing open of the two tubular chambers.

2. The three-sided pouch of claim 1, wherein the longitudinally extending sealing seam extends centrally between the two tubular chambers.

3. The three-sided pouch of claim 1, wherein one of the tubular chambers is wider than the other tubular chamber.

4. The three-sided pouch of claim 1, further comprising a longitudinally extending device for facilitating the separation of the two tubular chambers, said longitudinally extending device extending substantially centrally along the length of the longitudinally extending sealing seam.

* * * * *